US009038213B2

(12) United States Patent
Cuneo

(10) Patent No.: US 9,038,213 B2
(45) Date of Patent: May 26, 2015

(54) BED CLOTHING SYSTEM

(71) Applicant: Margo E. Cuneo, Lincoln, NE (US)

(72) Inventor: Margo E. Cuneo, Lincoln, NE (US)

( * ) Notice: Subject to any disclaimer, the term of this patent is extended or adjusted under 35 U.S.C. 154(b) by 0 days.

(21) Appl. No.: 13/652,228

(22) Filed: Oct. 15, 2012

(65) Prior Publication Data

US 2014/0101850 A1 Apr. 17, 2014

(51) Int. Cl.
*A47G 9/02* (2006.01)
*A47G 9/04* (2006.01)

(52) U.S. Cl.
CPC ..... *A47G 9/02* (2013.01); *A47G 9/0223* (2013.01); *A47G 9/0238* (2013.01); *A47G 9/04* (2013.01); *A47G 9/0246* (2013.01)

(58) Field of Classification Search
USPC ..... 5/497, 482, 494, 496, 500, 502, 485
See application file for complete search history.

(56) References Cited

U.S. PATENT DOCUMENTS 4,045,831 A 9/1977 Clark
4,308,626 A 1/1982 Weiss
5,165,128 A 11/1992 Honig
5,177,821 A 1/1993 Kawtoski
5,375,274 A 12/1994 Cuneo
6,108,836 A 8/2000 Keene, III
6,134,730 A 10/2000 Evanson
6,499,157 B1 12/2002 McCain et al.
6,502,258 B1 1/2003 Mitchell
6,725,477 B2 4/2004 Ciaglia et al.
6,892,404 B2 * 5/2005 Harbin et al. ..... 5/497
7,293,306 B2 11/2007 Hermanczuk
7,380,297 B2 6/2008 Bauer
7,487,561 B2 2/2009 Ho
2007/0151028 A1 7/2007 Bauer
2012/0159710 A1 6/2012 Mintz

* cited by examiner

*Primary Examiner* — Peter M Cuomo
*Assistant Examiner* — Brittany Wilson
(74) *Attorney, Agent, or Firm* — William W. Cochran; Cochran Freund & Young LLC

(57) ABSTRACT

Disclosed is a bed clothing system that has a bottom sheet and top sheet attached together at the corners of the foot end of the bed clothing system. At the foot end of the bed clothing system on the corners, where the top and bottom sheets are attached, a stretchable piece of material is disposed in a vertical direction so that the bed sheet system is able to accommodate to any size and thickness of a mattress, while also remaining securely fixed on a mattress.

12 Claims, 15 Drawing Sheets

BED CLOTHING SYSTEM

BACKGROUND

Bed clothing, such as, but not limited to, bed sheets and pillowcases have been utilized for many years to provide comfort, warmth, and to protect objects such as mattresses and pillows. Bed clothing can also be made of colorful patterns that add aesthetic value to beds.

SUMMARY

An embodiment of the present invention may therefore comprise a bed clothing system that accommodates a plurality of mattress thicknesses comprising: a bottom sheet; a first corner on the bottom sheet having a first stretchable material disposed in a direction aligned with the thickness of the mattress; a second corner on the bottom sheet having a second stretchable material disposed in a direction aligned along the thickness of the mattress; a third corner on the bottom sheet; a forth corner on the bottom sheet; a top sheet connected to the bottom sheet along an axis substantially perpendicular to the mattress thickness; a first corner on the top sheet; a second corner on the top sheet; a third corner on the top sheet that is attached to the third corner of the bottom sheet by a third stretchable material disposed in a direction so that the third stretchable material can substantially adapt to a thickness of the mattress, so that the third stretchable material can allow a substantial amount of foot room; a forth corner on the top sheet that is attached to the forth corner of the bottom sheet by a forth stretchable material disposed in a direction so that the stretchable material can adapt to the thickness of the mattress and allow the substantial amount of foot space between the bottom sheet and the top sheet.

An embodiment of the present invention may further comprise a bed clothing system that accommodates a plurality of mattress thicknesses comprising: a bottom sheet; a top sheet having a first corner, a second corner, a third corner and a forth corner so that the top sheet is connected to the bottom sheet in a direction perpendicular to the thickness of the mattress; a first corner of the bottom sheet having a first portion and a second portion so that the first portion and the second portion are attached with a first stretchable material between the first portion and the second portion of the first corner; a second corner of the bottom sheet having a third portion and a forth portion that are attached with a second stretchable material between the third and the second portions of the second corner; a third corner of the bottom sheet having a fifth portion and a sixth portion that are attached to a third stretchable material in a direction aligned with the mattress thickness and the third corner of the bottom sheet is attached to the third corner of the top sheet so that the third corner of the bottom sheet and the third corner of the top sheet expand to allow a substantial amount of room between the third corner of the bottom sheet and the third corner of top sheet; a forth corner of the bottom sheet having a seventh portion and an eighth portion that are attached to a forth stretchable material in a direction aligned with the mattress thickness, and the forth corner of the bottom sheet is attached to the forth corner of the top sheet so that the forth corner of the bottom sheet and the forth corner of the top sheet expand to allow a substantial amount of room between the forth corner of the bottom sheet and the forth corner of the top sheet.

An embodiment of the present invention may further comprise a method of constructing a bed clothing system capable of accommodating a plurality of various mattress thicknesses comprising: providing a bottom sheet; disposing a first stretchable material on a first corner on the bottom sheet in a direction aligned with the thickness of the mattress; disposing a second stretchable material on a second corner of the bottom sheet in a direction substantially aligned with the thickness of the mattress; providing a third corner to the bottom sheet; providing a forth corner to the bottom sheet; connecting a top sheet to the bottom sheet along an axis substantially perpendicular to the mattress thickness; providing a first corner on the top sheet; providing a second corner on the top sheet; attaching a third corner on the top sheet to the third corner of the bottom sheet with a third stretchable material that is disposed in a direction so that the third stretchable material can substantially adapt to a thickness of the mattress so that the third stretchable material can allow a substantial amount of foot room; attaching a forth corner on the top sheet to the forth corner of the bottom sheet with a forth stretchable material disposed in a direction so that the forth stretchable material can substantially adapt to a thickness of the mattress so that the forth stretchable material can allow a substantial amount of foot space between the bottom sheet and the top sheet.

An embodiment of the present invention may further comprise a method of constructing a bed clothing system capable of accommodating a plurality of various mattress thicknesses comprising: providing a bottom sheet; providing a top sheet having a first corner, a second corner, a third corner, and a forth corner so that the top sheet is connected to the bottom sheet in a direction substantially perpendicular to the thickness of the mattress; attaching a first portion and a second portion of the first corner of the bottom sheet with a first stretchable material; attaching a first portion and a second portion of the corner of the bottom sheet with a second stretchable material; attaching a third stretchable material to a first portion and a second portion of the third corner of bottom sheet and the third corner of top sheet so that the third stretchable material is in a direction substantially aligned with the mattress thickness so that the third corner of the bottom sheet and the third corner of the top sheet expand to allow a substantial amount of room between the third corner of the bottom sheet and the third corner of the top sheet; attaching a forth stretchable material to a first portion and a second portion of the forth corner of bottom sheet and the third corner of top sheet so that the forth stretchable material is in a direction substantially aligned with the mattress thickness so that the forth corner of the bottom sheet and the forth corner of the top sheet expand to allow a substantial amount of room between the forth corner of the bottom sheet and the forth corner of top sheet.

DETAILED DESCRIPTION OF THE EMBODIMENTS

Figure 1:
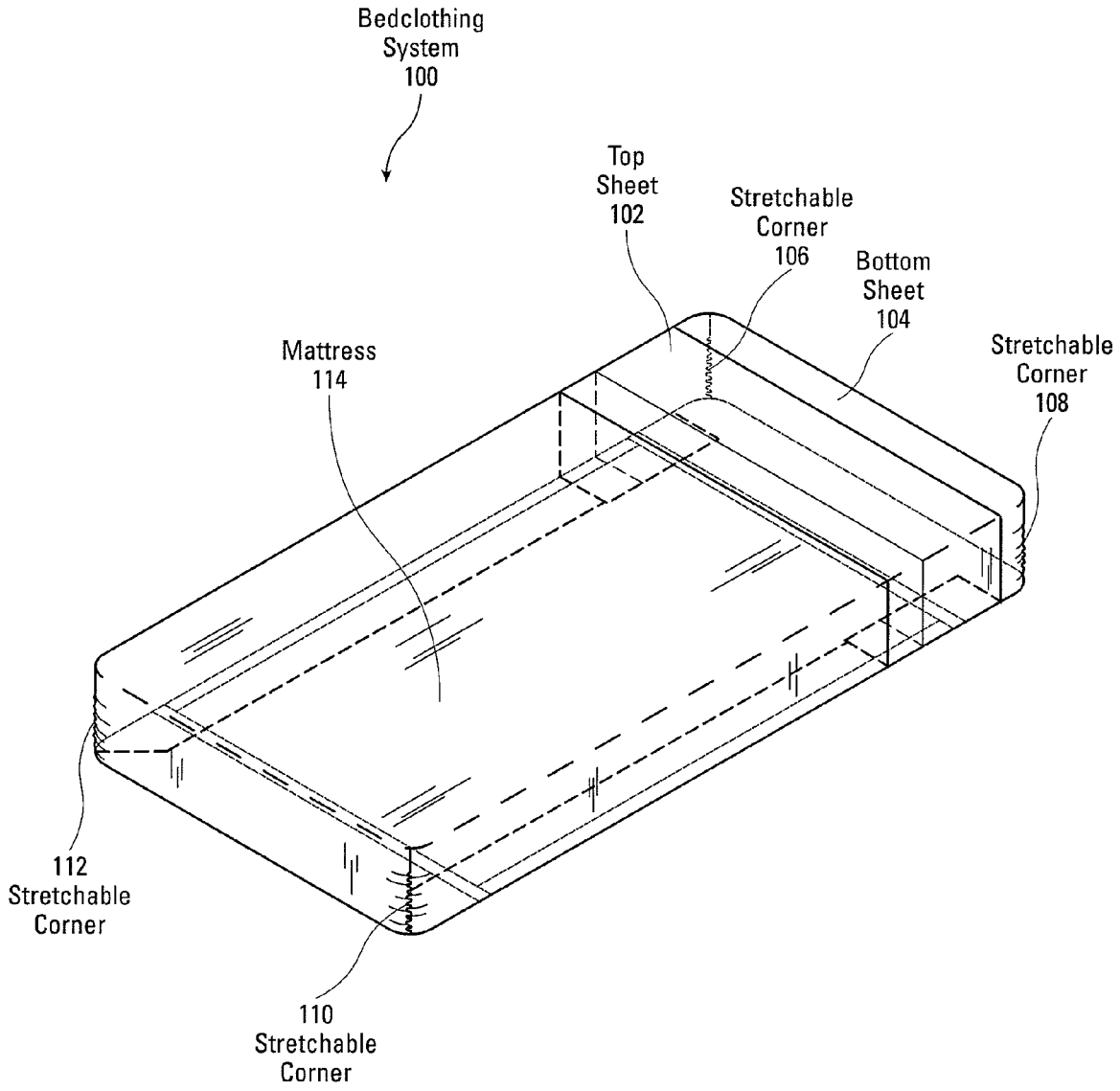
FIG. 1 is an isometric view of an embodiment of a bed clothing system.

FIG. 1 is an isometric view of an embodiment of bed clothing system 100. FIG. 1 shows bed clothing system 100 having a top sheet 102 and bottom sheet 104 disposed on mattress 114. Top sheet 102 and bottom sheet 104 are connected at stretchable corners 110, 112. Bottom sheet 104 has stretchable corners 106,108. Stretchable corners 106, 108, 110, 112 all contain a stretchable material, such as, but not limited to, elastic or any other type of stretchable material, that is disposed in a vertical direction, so that bed clothing system 100 will comfortably and easily fit on mattress 114 regardless of the size of mattress 114.

Figure 2:
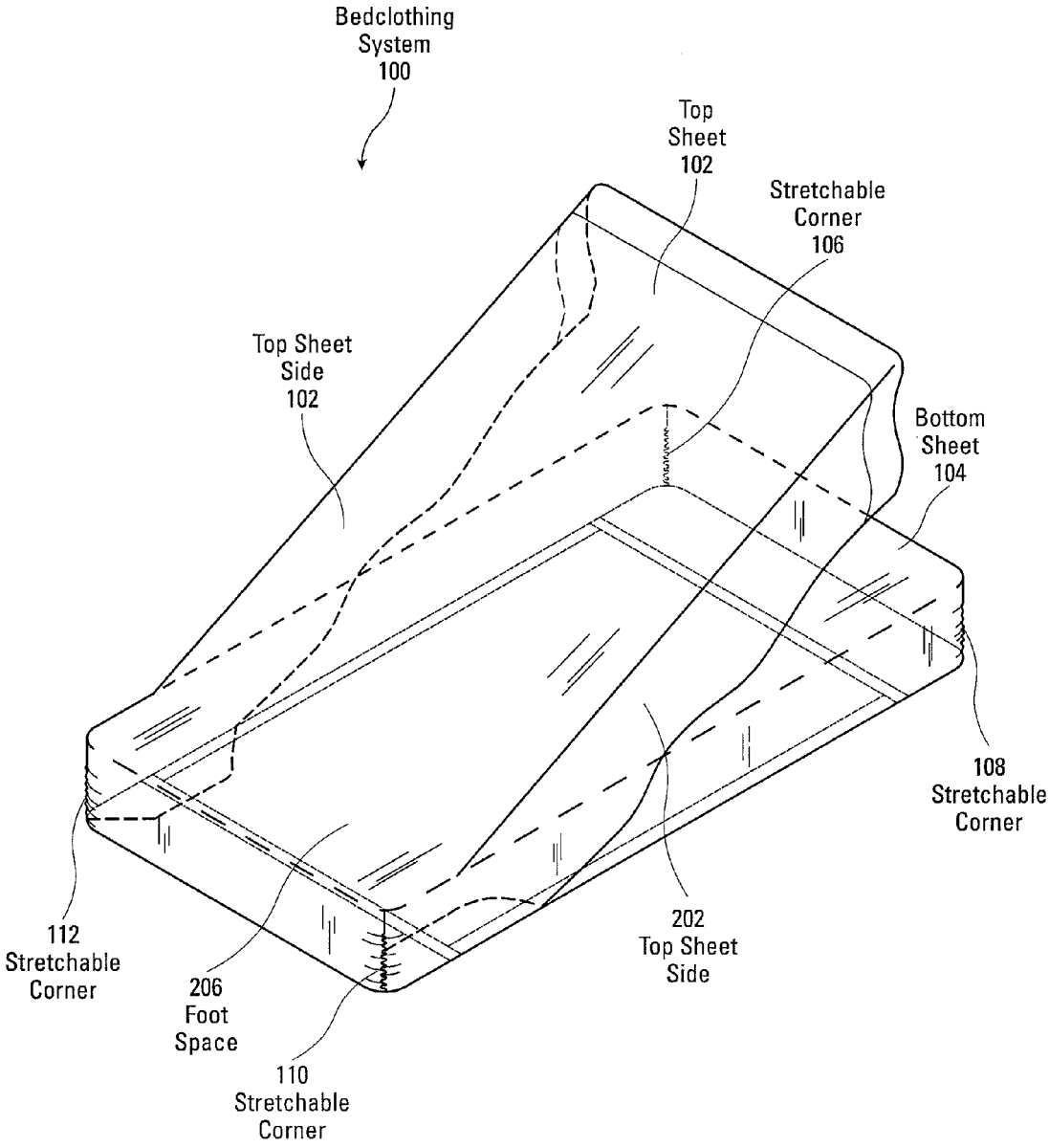
FIG. 2 is another isometric view of FIG. 1.

FIG. 2 is an isometric view of FIG. 1 showing top sheet 102 lifted from bottom sheet 104 on bed clothing system 100. Top sheet 102 is connected to bottom sheet 104 at stretchable corners 110, 112 so that top sheet 102 will not come off of bed clothing system 100 thereby allowing the user to rapidly, with a minimal amount of steps, employ bed clothing system 100 on mattress 114. For example, a user in a wheelchair can easily and rapidly lean over bottom sheet 104 and pull top sheet 102 over bottom sheet 104 and the bed clothing system is instantly made. In addition, people who make multiple beds a day, such as maids, can be saved hours of work from making beds, as a result of the ease of use of bed clothing system 100 and the reduced amount of steps that are usually required using standard sheets. Furthermore, because bed clothing system 100 has vertical stretchable corners 106, 108, 110, 112, the stretchable corners 106,108, 110, 112 can be pulled over any standard size mattress 104 with ease, regardless of the length or thickness of mattress 114. Also, if mattress 114 has any contours due to a new mattress design, or is an old mattress, the vertical stretchable corners 106, 108, 110, 112 allow an improved over-all fit so bed clothing system 100 fits comfortably and securely to mattress 114 and forms clean hospital-type corners. Also, stretchable corners 106 108, 110, 112 eliminate the problem of bedclothes becoming too tight because of shrinking because stretchable corners 106, 108, 110, 112 are designed to stretch and fit multiple mattress sizes. While in use, stretchable corners 106, 108 remain intact while top sheet 102, having top sheet sides 202, 204, is elevated from bottom sheet 104, so that stretchable corners 110, 112 may expand to provide for foot space 206 in the case that foot space 206 is needed for a user. Also, because top sheet 102 is connected to bottom sheet 104 at stretchable corners 110, 112, a child cannot become tangled or wrapped up in bed clothing system 100 because top sheet 102 does not slip or move from bottom sheet 104. In addition, a user does not have to worry about losing top sheet 102, because when a user twists or turns, top sheet 102 cannot fall off, or slip off, bottom sheet 104.

Figure 3:
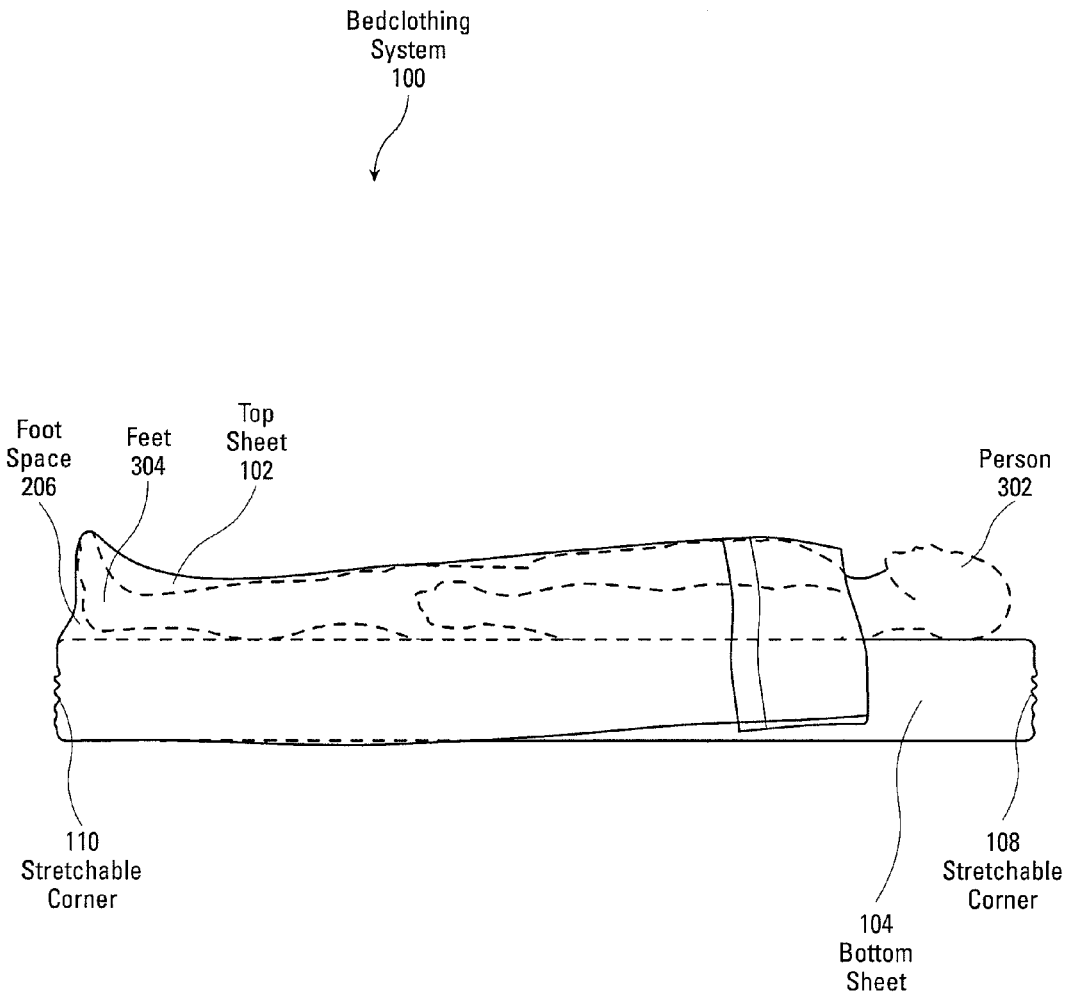
FIG. 3 is a side view of FIG. 1.

FIG. 3 is an isometric side view of bed clothing system 100. FIG. 3 shows bed clothing system 100 having a person 302 having feet 304 in foot space 206. FIG. 3 shows person 302 lying on bottom sheet 104, which has stretchable corner 108. Top sheet 102, which is connected to bottom sheet 104, at stretchable corner 110, provides foot space 206 so the person 302 can allow for proper foot room located at foot space 206 for person 302 feet. In other words, person 302 has adequate and ample foot space 206 for feet 304 because stretchable corner 110 stretches in a vertical direction so that feet 304 have a substantial, and comfortable foot space 206. Similarly, but not shown in FIG. 3 (shown in FIG. 2) stretchable corner 112 stretches thereby allowing ample and sufficient foot space 206 to keep the user's feet 304 (FIG. 3) comfortable.

Figure 4:
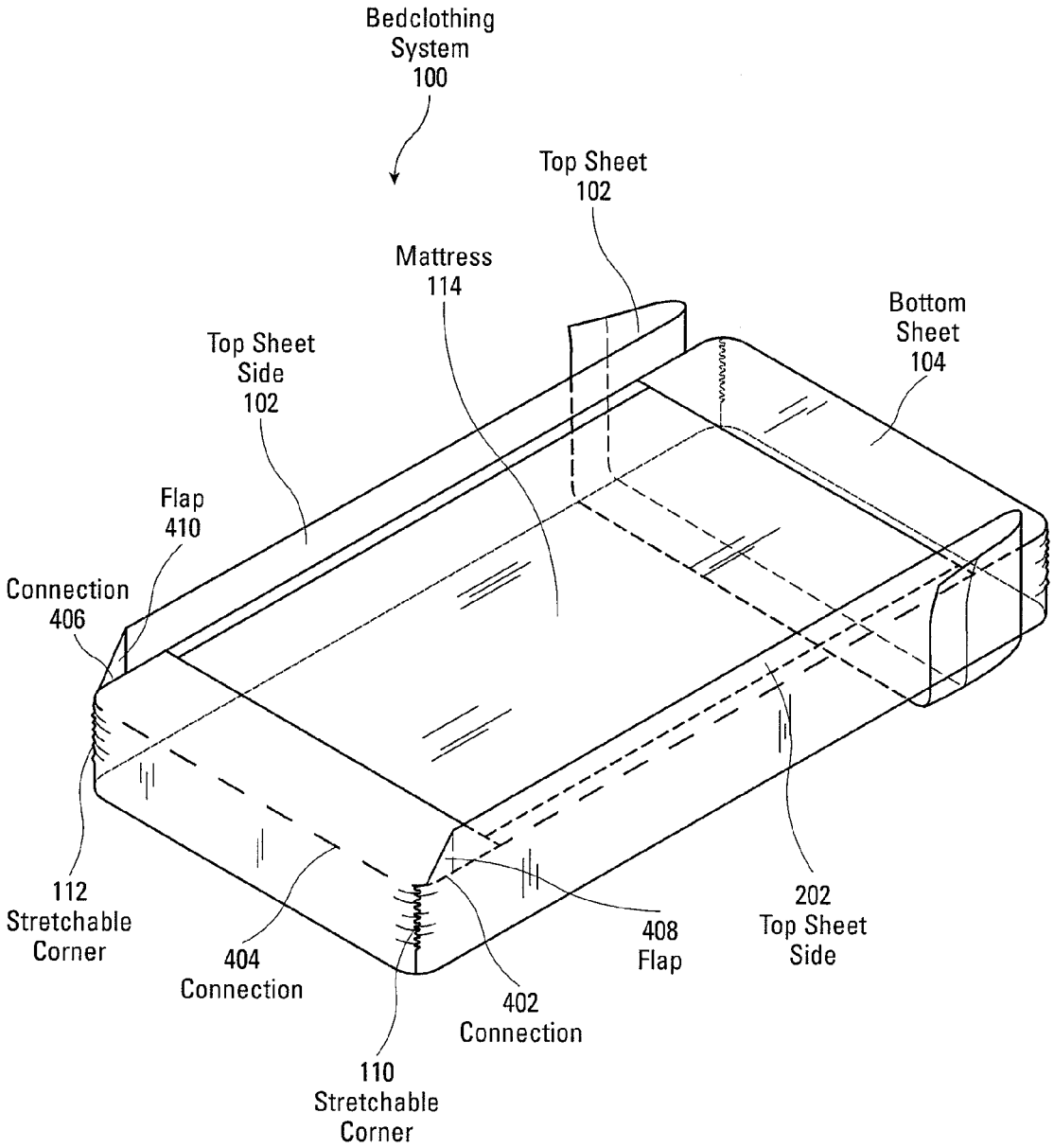
FIG. 4 is a isometric bottom view of FIG. 1.

FIG. 4 is a bottom isometric view of FIG. 1, showing the bottom side of mattress 114. Bed clothing system 100 is disposed on mattress 114 so that bottom sheet 104 is securely attached to mattress 114. Top sheet sides 202, 204 are shown un-tucked for mattress 114. Top sheet 102 is connected to bottom sheet 104 at connections 402, 404, 406 and at stretchable corners 110, 112. Connections 402, 404, 406 can be attached in various ways and are not limited to sewing, and may also incorporate a stretchable material such as elastic, if desired. Connection 402 connects top sheet side 202 to bottom sheet 104, so that connection 402 provides a flap 408 on top sheet side 202. When top sheet side 202 is folded under mattress 114, flap 408 creates a hospital corner, which is usually very difficult and time consuming to obtain if bottom sheet 104 and top sheet 102 are not attached with top sheet having flap 408. Similarly, connection 406 connects bottom sheet 104 to top side sheet 204, thus creating flap 410 so that when flap 410 is folded under mattress 114. As such, a clean hospital corner is created near stretchable corner 112. In addition, bed clothing system also accommodates for mattresses 114 that incorporate pillow tops and need to be occasionally flipped because stretchable corners 106, 108, 110, 112 allow the bottom fit of bottom sheet 104 to fit underneath mattress 114 to accommodate for a flipped pillow top. Most sheets cannot accommodate the added width of a flipped pillow top.

Figure 5:
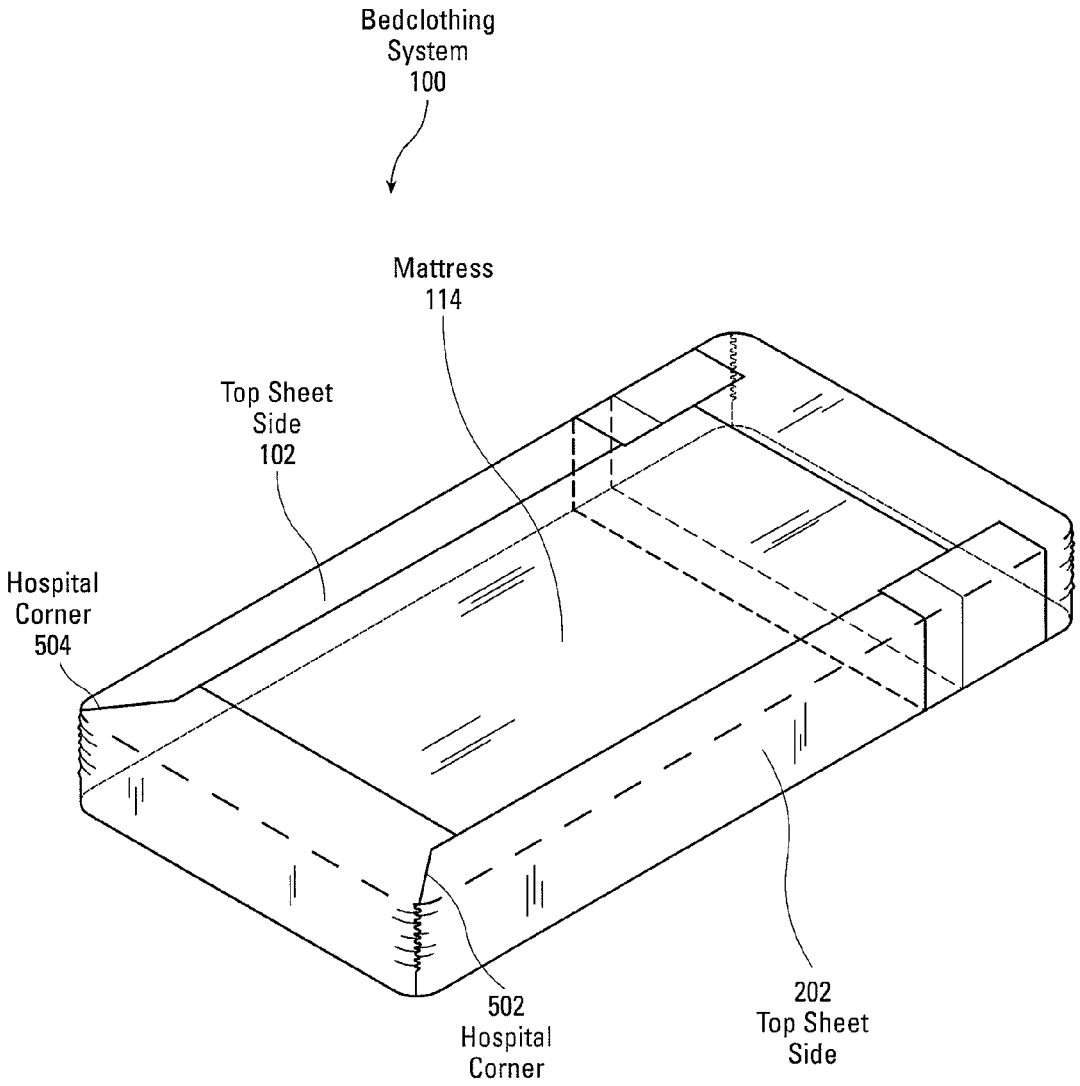
FIG. 5 is an isometric bottom view of FIG. 1.

FIG. 5 is a similar view as FIG. 4. However, FIG. 5 shows top sheet sides 202, 204 tucked under mattress 114, so that hospital corners 502, 504 are created for bed clothing system 100.

Figure 6:
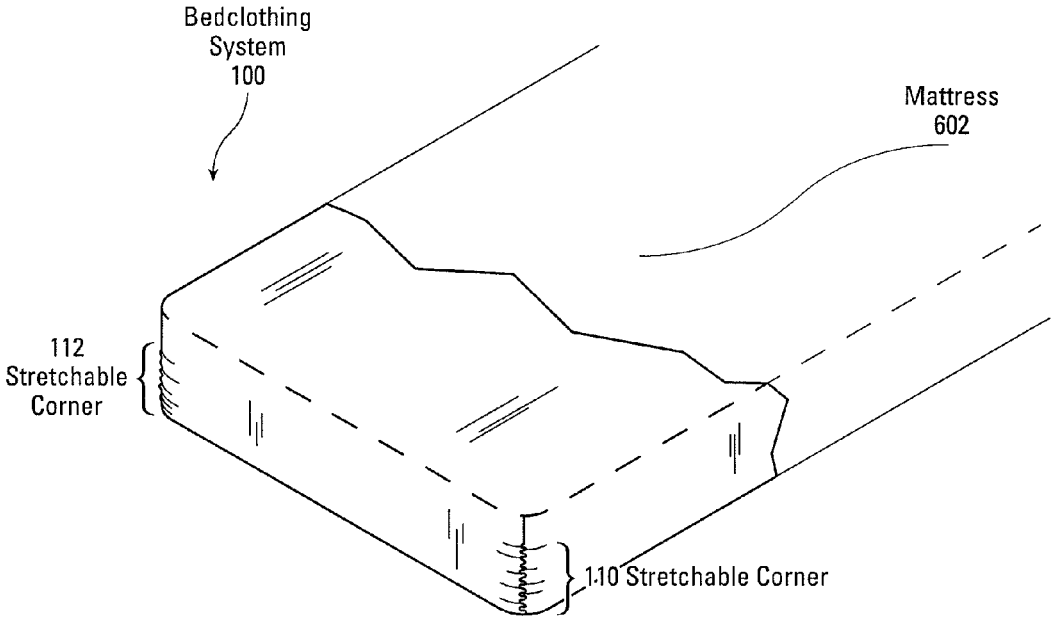
FIG. 6 is a partial, isometric view of FIG. 1.
Figure 7:
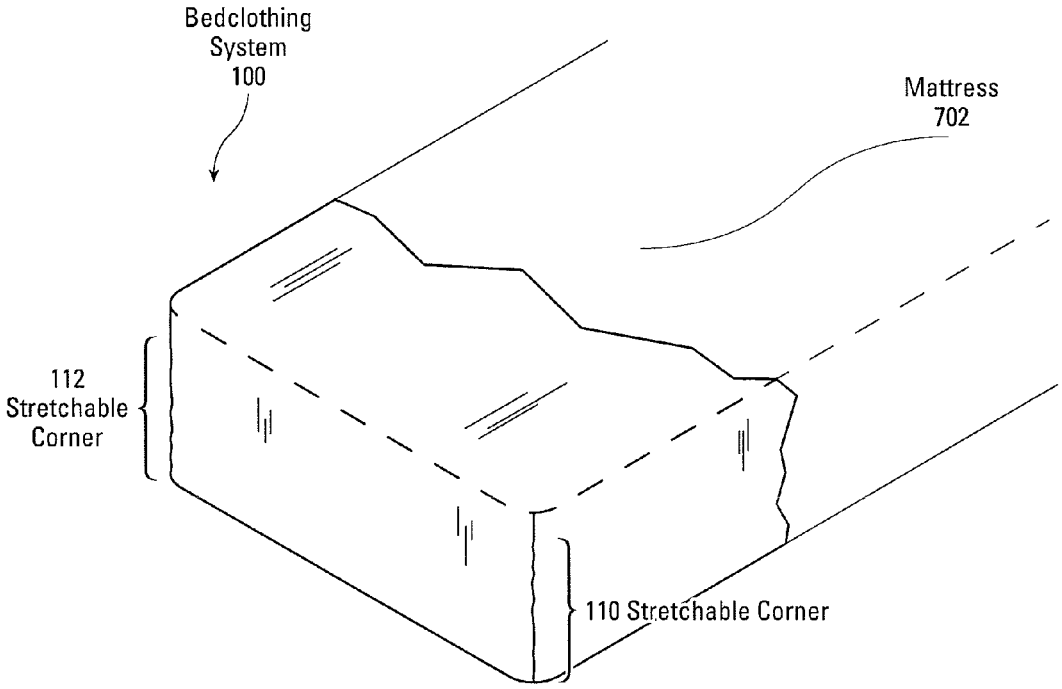
FIG. 7 is a partial, isometric view of FIG. 1.

FIGS. 6 and 7 show stretchable corners 110, 112. Stretchable corners 110, 112 allow for bed clothing system 100 to use mattresses having various sizes including varying depths. In other words, bed clothing system 100 can be designed for any standard size mattress regardless of the mattress depth. Bed clothing system 100 can be comfortably and easily employed on various sizes of mattresses because stretchable corners 110, 112 are capable of adapting to various sizes and thicknesses of mattresses as shown in FIGS. 6 and 7. In other words, FIG. 6 shows bed clothing system 100 disposed on mattress 602 that is shorter in vertical distance (i.e. thickness) than the mattress 702 in FIG. 7. Stretchable corners 110, 112, shown in FIGS. 6 and 7, of bed clothing system 100, are able to adapt comfortably and stay on the two different thicknesses of mattresses illustrated in FIGS. 6 and 7. Stretchable corners 110, 112 can be constructed in various ways, as disclosed with respect to FIGS. 8 through 11.

Figure 8:
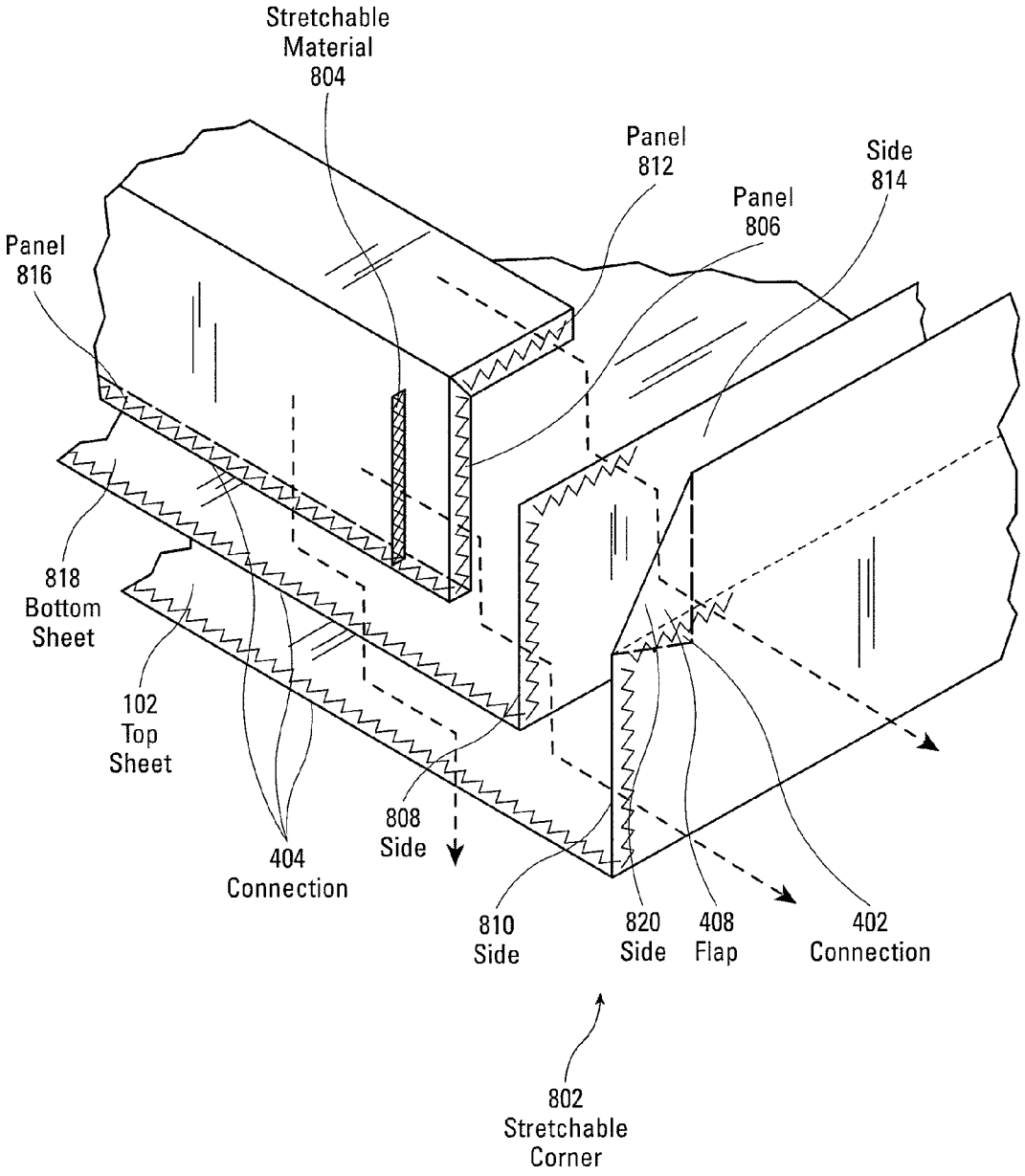
FIG. 8 is an exploded bottom view of one embodiment of FIG. 7.

FIG. 8 is an exploded view of one embodiment of a stretchable corner 110. For illustrative purposes, in FIGS. 8-11, stretchable corner 110 is described. It should be noted that stretchable corner 112 can also be constructed in the same manner as stretchable corner 110. It should also be noted that stretchable corners 110,112 can be connected by means, such as but not limited to, sewing, gluing, fusing, or by any other means known to those skilled in the art for connecting fabric.

FIG. 8 is an exploded view of stretchable corner 802. FIG. 8 shows stretchable corner 802 that is constructed by attaching stretchable material 804 to panel 806, which is then attached to side 808, then finally attached to side 810. In other words, stretchable material 804 is attached in the interior of panel 806, then is attached to the side 808 of bottom sheet 818, then attached to side 810 of top sheet 102, so that stretchable material is inside bottom sheet 104 and is not visible. Panel 812 is attached to side 814, which is attached side 820, thus creating flap 408, and connection 402 (shown in FIG. 4), which also creates hospital corner 502 (shown in FIG. 5). Panel 816 is attached to bottom sheet 818, which is attached to top sheet 102 to create connection 404 as was shown in FIG. 4.

Figure 9:
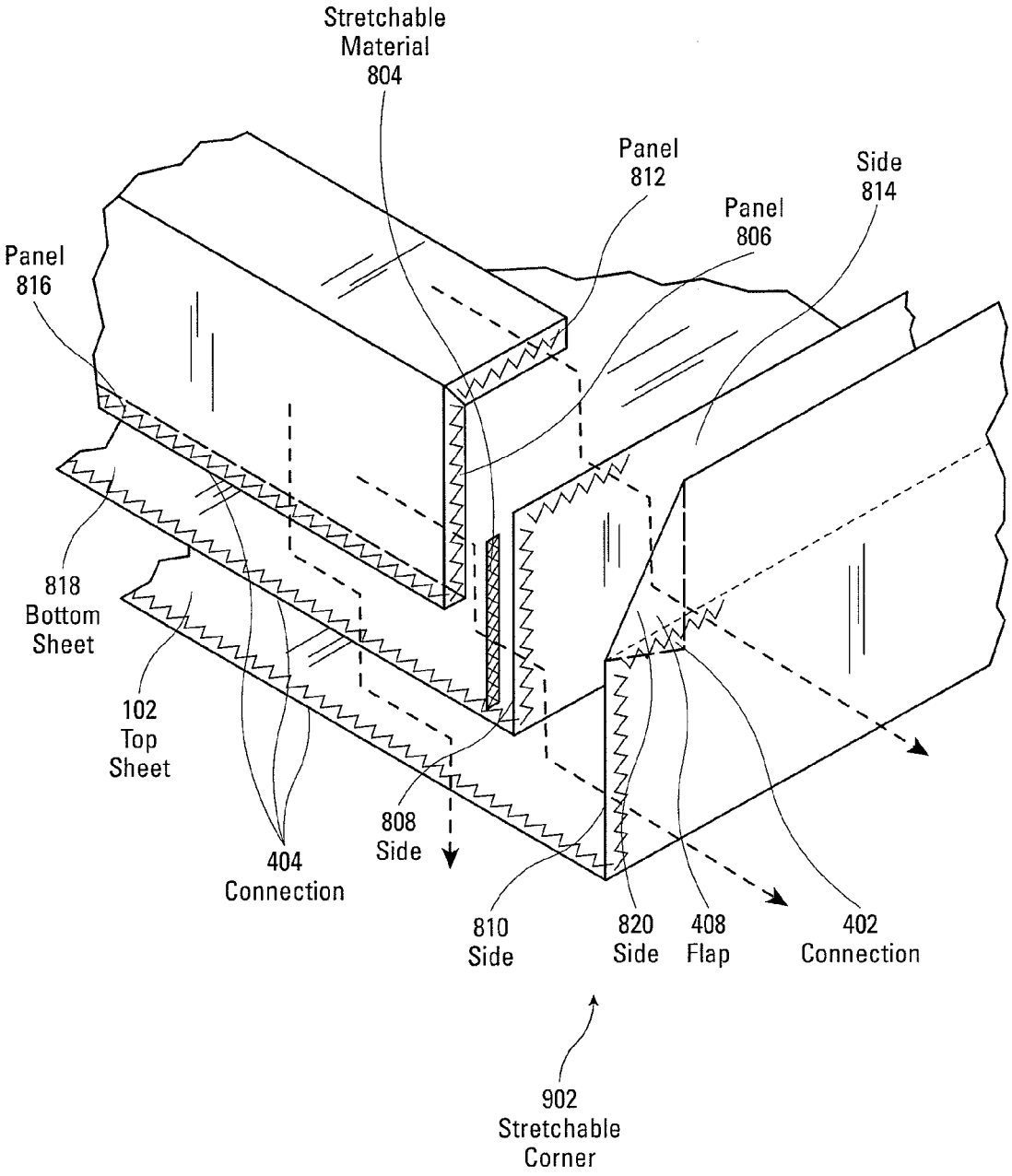
FIG. 9 is an exploded bottom view another embodiment of FIG. 7.

FIG. 9 shows another way that stretchable corners 110, 112, that were shown in FIGS. 6 and 7, may be constructed. FIG. 9 shows stretchable corner 902 constructed by connecting panel 806 to stretchable material 804, which then is connected to side 808 on bottom sheet 818, which is then connected to side 810, which is located on top sheet 102. Panel 816 is attached to bottom sheet 818 which is attached to top sheet 102 creating connection 404 as was shown in FIG. 4. Panel 812 is connected to side 814, which is then connected to side 820, creating flap 408, which was shown in FIG. 4, so that flap 408 then creates a clean hospital corner 502, as was shown in FIG. 5. In other words, stretchable material 804 is located between panel 806 and side 808 of bottom sheet 104, so that stretchable material is not exposed on the inside of bottom sheet 104, which assists in preserving the lifespan of stretchable material 804. Also, having stretchable material 804 attached between panel 806 and side 808 is beneficial because stretchable material 804 is not exposed to constant wear and tear due to washing, drying, and constant rubbing against body and sheet use. Also, the location of the stretchable material allows users additional comfort and is attractive because the bed clothing system looks clean, smooth and neat without visible elastic showing.

Figure 10:
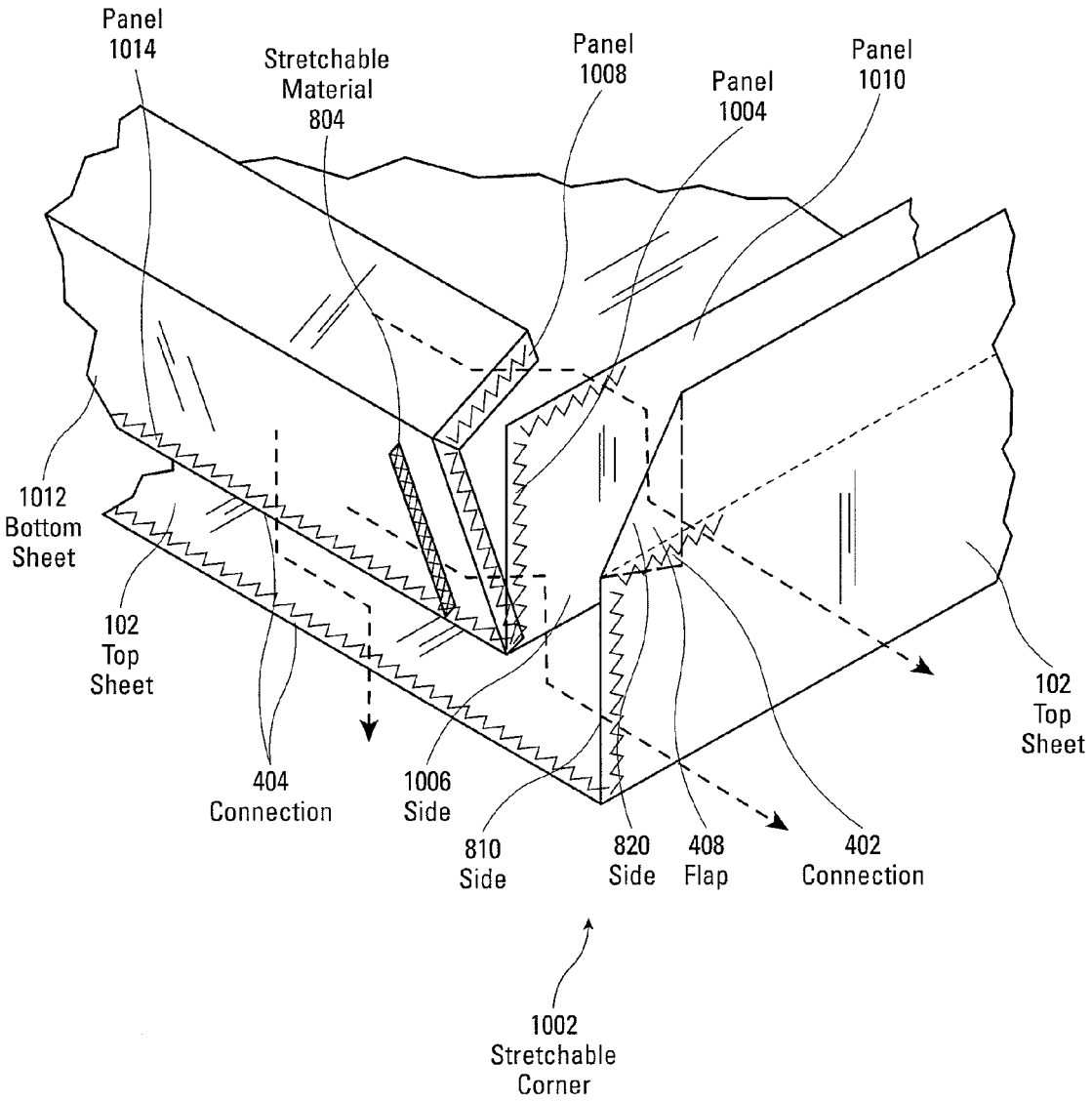
FIG. 10 is an exploded bottom view of another embodiment of FIG. 7.

FIG. 10 shows another way in which stretchable corners 110, 112, as shown in FIGS. 6 and 7, may also be constructed. FIG. 10 shows stretchable corner 1002, which is constructed by connecting stretchable material 804 to panel 1004, which is then connected to side 1006, which is then connected to side 810. Panel 1014 located on bottom sheet 1012 is attached to side 1016 located on top sheet 102 so that connection 404 is created as seen in FIG. 4. Panel 1008 is attached to panel 1010, which is attached to side 820 located on top sheet 102, which is shown as connection 402 in FIG. 4. Connection 402 to panel 1010 creates flap 408, which will allow the user to easily form a hospital corner 502, as was shown in FIG. 5.

Figure 11:
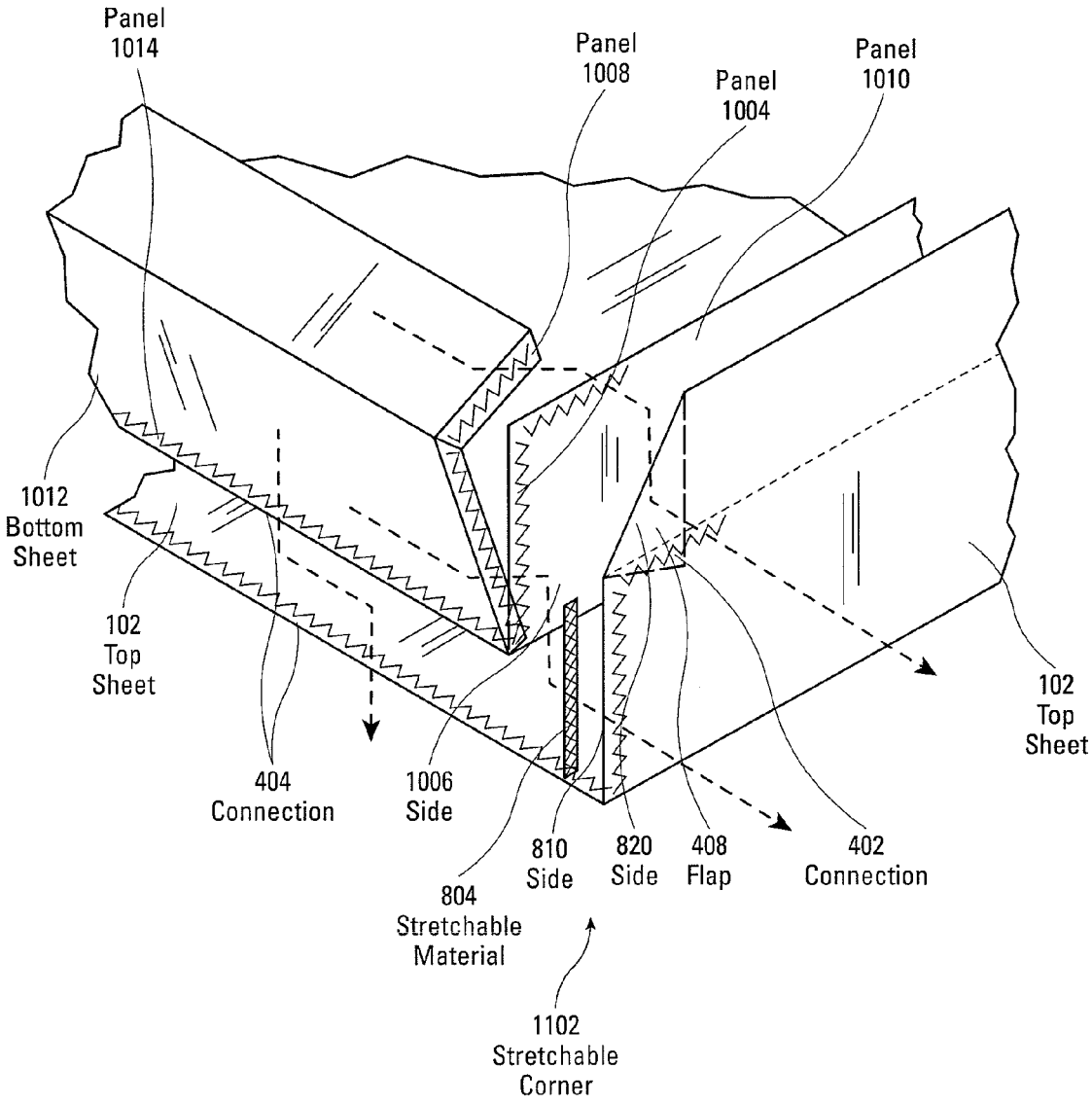
FIG. 11 is an exploded bottom view of another embodiment of FIG. 7.

FIG. 11 shows another way that stretchable corners 110, 112, shown in FIGS. 6 and 7, may also be constructed. FIG. 11 shows stretchable corner 1102 constructed by attaching panel 1004 located on bottom sheet 1012 to side 1006, which is then connected to stretchable material 804, which is then connected to side 810. Panel 1008 is then connected to panel 1010, which is then connected to side 820 to create connection 402 located on top sheet 102, which creates flap 408, which was shown in FIG. 4, so that flap 408 can easily be folded into a clean hospital corner 502, as was shown in FIG. 5. Also, having stretchable material 804 attached between side 1006 and side 810 is beneficial because stretchable material 804 is not exposed to constant wear and tear due to washing, drying, and constant rubbing against body and sheet use. Also, the location of the stretchable material allows users additional comfort and is attractive because the bed clothing system looks clean, smooth and neat without visible elastic showing.

FIGS. 12-15 show a stretchable corner (either 110 or 112 in FIG. 1) that is shown turned inside out to illustrate the manner in which the corners can be sewn. However, the construction of stretchable corners 110, 112 can be connected by means other than sewing such as gluing, fusing or by any other means known to others skilled in the art for connecting fabric. For illustrative purposes, FIGS. 12-15 use the view of stretchable corner 110, however stretchable corner 112 can be constructed in the same manner.

Figure 12:
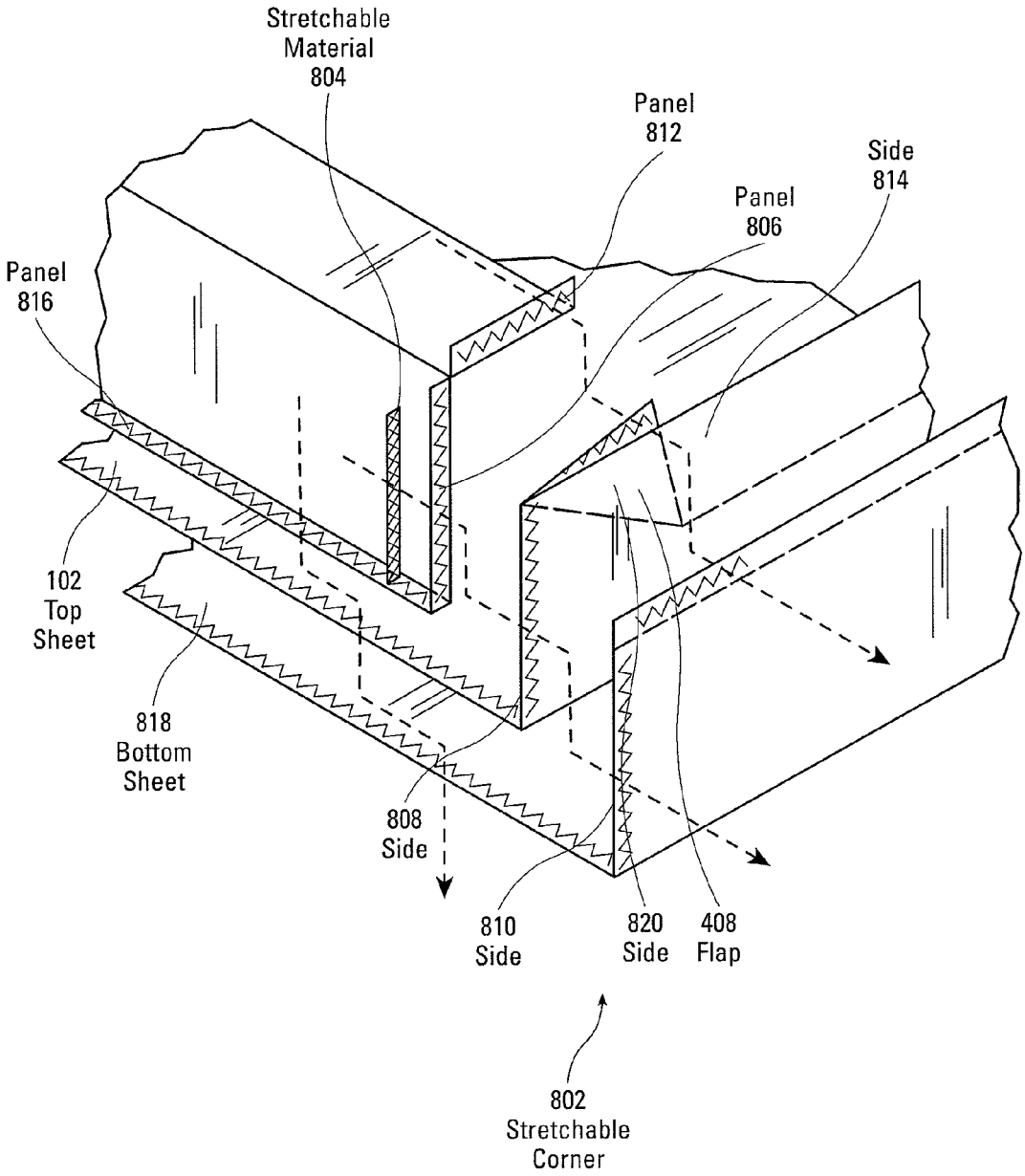
FIG. 12 is an exploded internal bottom view of the embodiment of FIG. 8.

FIG. 12 shows one way that stretchable corners 110, 112, (shown in FIGS. 6 and 7) can be constructed. Stretchable material 804 is attached to panel 806, which is attached to side 808, and then attached to side 810. Panel 812 is attached to side 814, and then attached to side 820 which creates flap 408. Panel 816 is attached to top sheet 102, which is then attached to bottom sheet 818. If the constructed stretchable corner 802 in FIG. 12 is turned inside out, stretchable corner 802 will create assembled stretchable corner 802 shown in FIG. 8.

Figure 13:
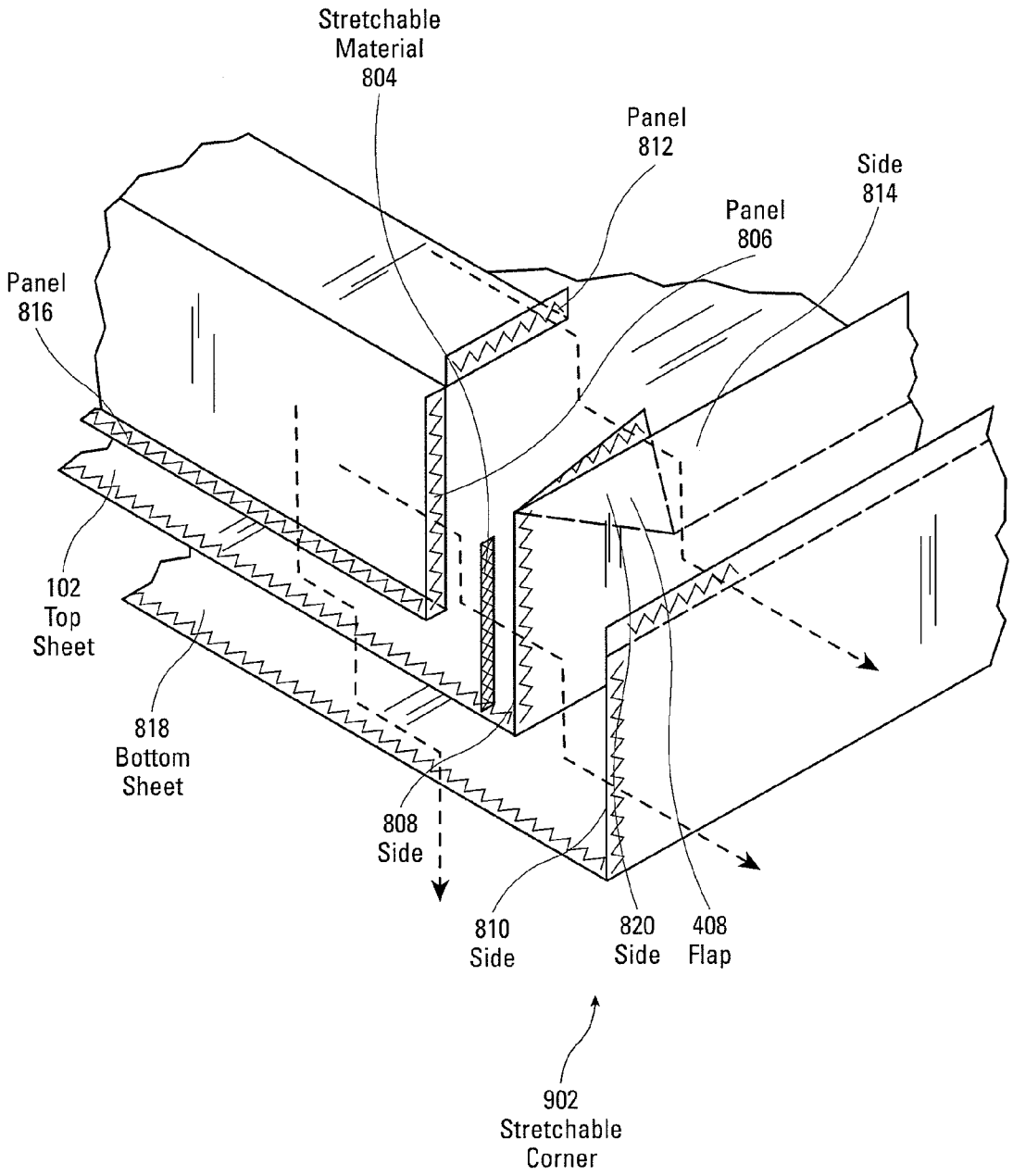
FIG. 13 is an exploded internal bottom view of the embodiment of FIG. 9.

FIG. 13 shows another way that stretchable corners 110, 112, (shown in FIGS. 6 and 7) can be constructed. Panel 806 is attached to stretchable material 804, then attached to side 808, and finally attached to side 810. Panel 816 is attached to top sheet 102, which is then attached to bottom sheet 818. Panel 812 is attached to side 814, which is then attached to side 820, which creates flap 408. If the constructed stretchable corner 902 in FIG. 13 is turned inside out, stretchable corner 902 will create assembled stretchable corner 902 shown in FIG. 9.

Figure 14:
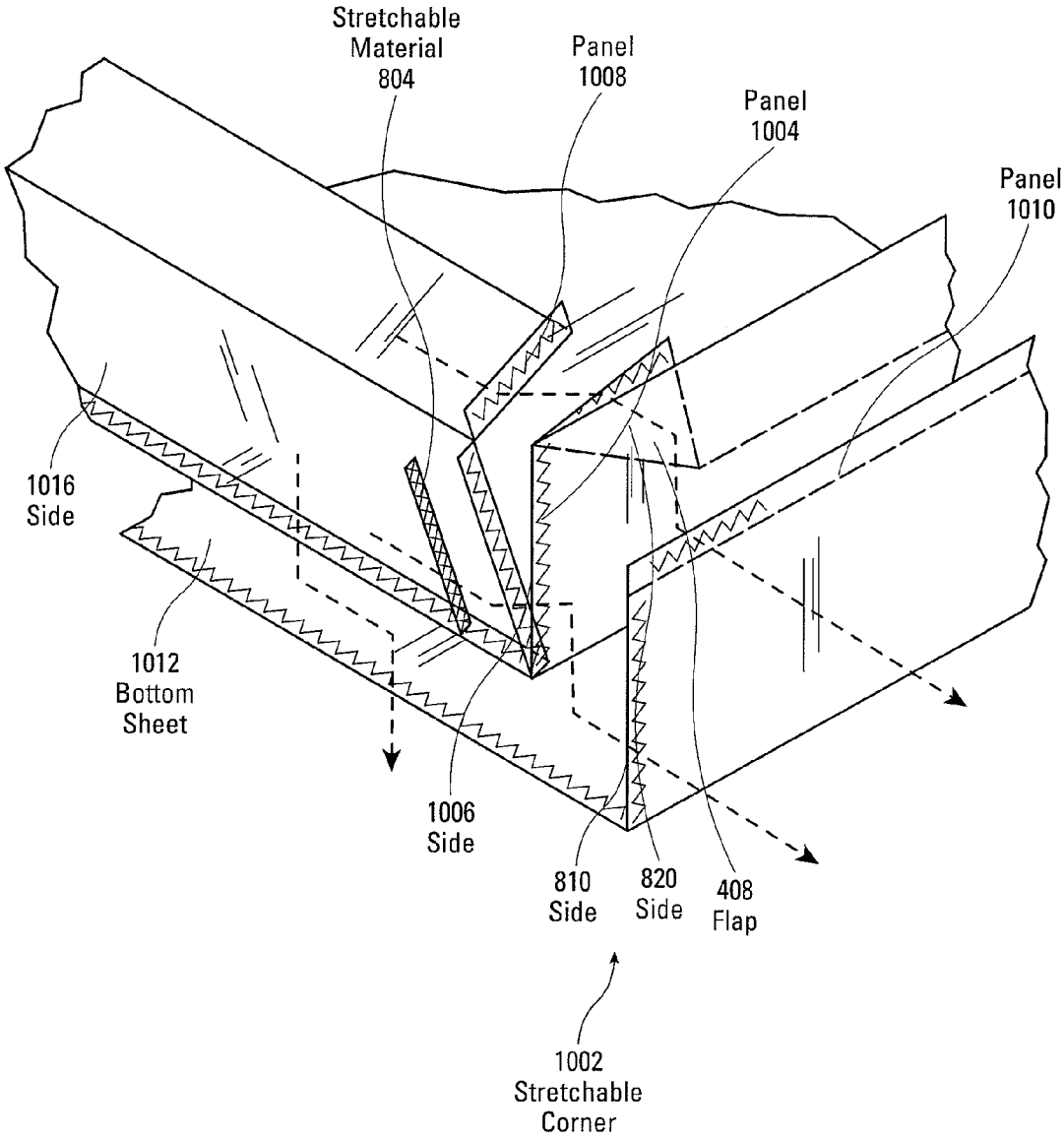
FIG. 14 is an exploded internal bottom view of the embodiment of FIG. 10.

FIG. 14 shows another way that stretchable corners 110, 112, (shown in FIGS. 6 and 7) can be constructed. Panel 1008 is attached to side 820, and then attached to panel 1010, thus creating flap 408. Stretchable material 804 is attached to side 1006, panel 1004, then attached to side 810. Side 1016 is attached to bottom sheet 1012. If the constructed stretchable corner 1002 in FIG. 14 is turned inside out, stretchable corner 1002 will create assembled stretchable corner 1002 shown in FIG. 10.

Figure 15:
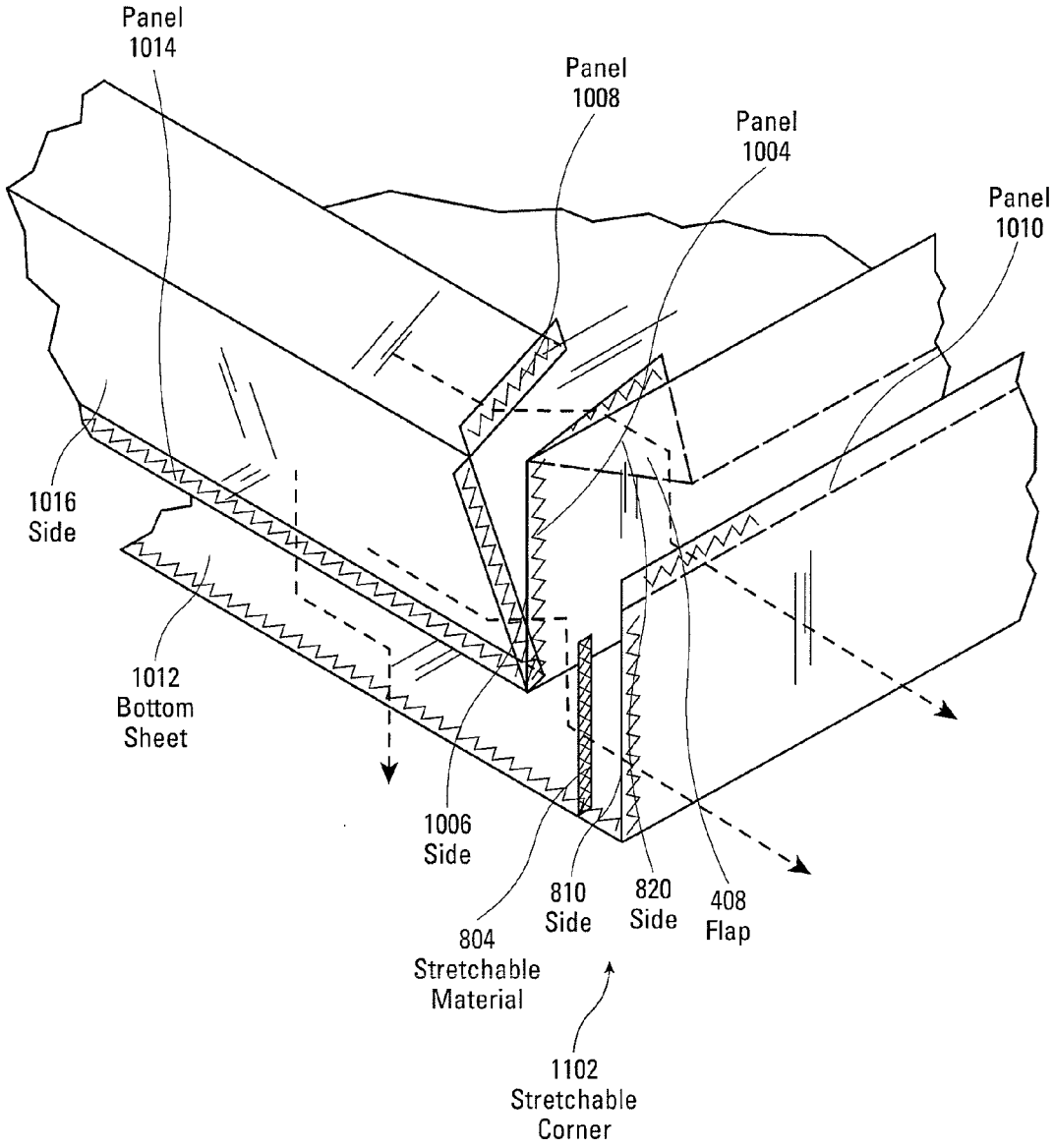
FIG. 15 is an exploded internal bottom view of the embodiment of FIG. 11.

FIG. 15 shows another way that stretchable corners 110, 112, (shown in FIGS. 6 and 7) can be constructed. Panel 1008 is attached to side 820, and then attached to panel 1010, thus creating flap 408. Side 1006 is attached to panel 1004 which is attached to stretchable material 804, and finally attached to side 810. Finally, panel 1014 is attached to bottom sheet 1012. If the constructed stretchable corner 1102 in FIG. 15 is turned inside out, stretchable corner 1102 will create assembled stretchable corner 1102 shown in FIG. 11.

Figure 16:
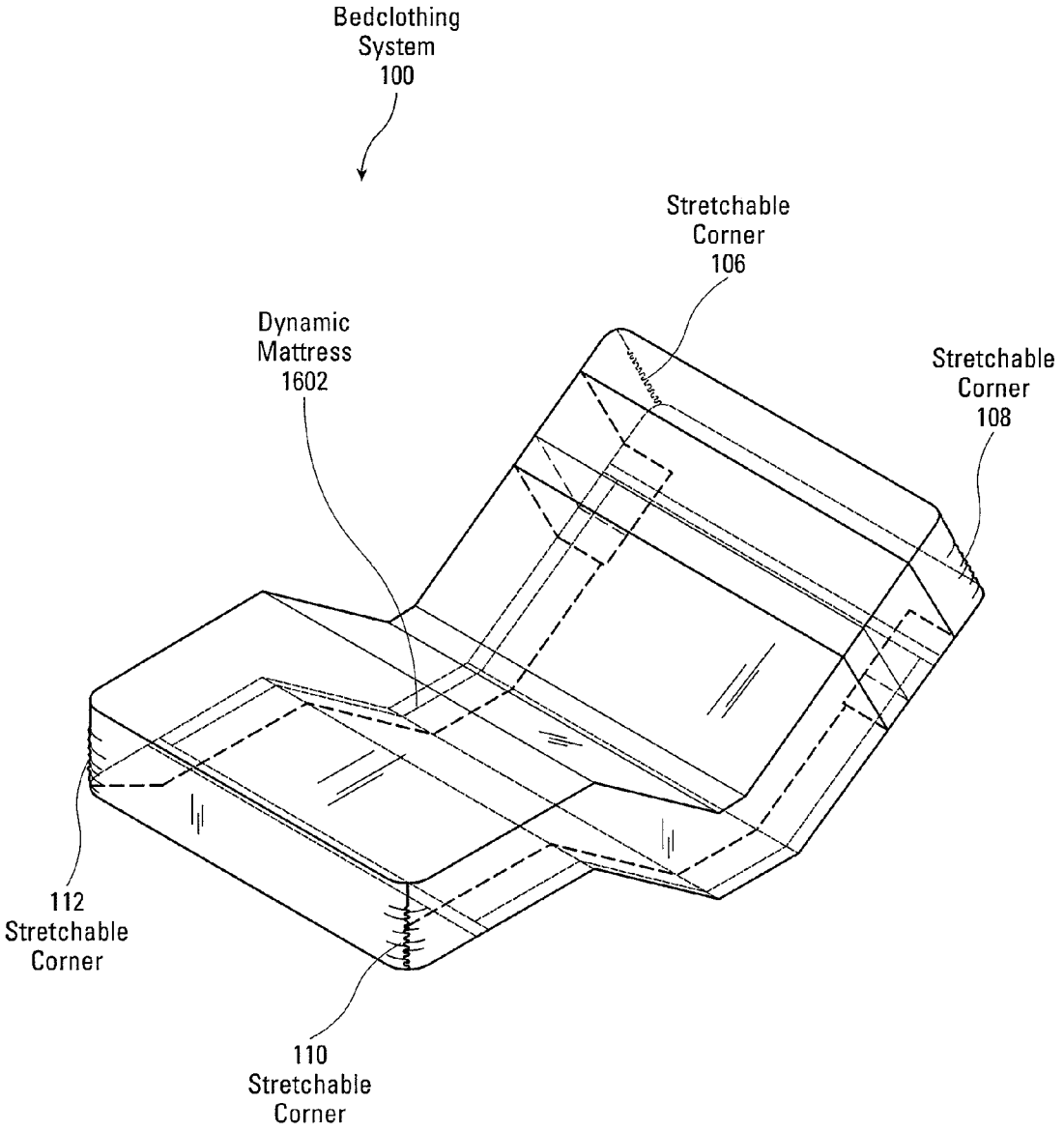
FIG. 16 is an isometric view of the embodiment of FIG. 1 on a dynamic mattress.

FIG. 16 shows bed clothing system 100 disposed on a dynamic mattress 1602. A dynamic mattress is defined as a mattress that is capable of moving and bending in various directions, such as a hospital bed, Craftmatic or Temperpedic mattress. When the dynamic mattress 1602 moves, bed clothing system 100 is able to be securely maintained with a comfortable close fit on dynamic mattress 1202 because stretchable corners 106, 108, 110, 112 are able to automatically stretch and retract to fit whatever position dynamic mattress 1602 is in. Also, bed clothing system is able to adapt to and comfortably fit other types of beds, such as, but not limited to, sofa beds, folding mattresses, hide-a beds, and airplane seats that turn into beds. The stretchable corners 106, 108, 110, 112 allow for any bending or movement without bed clothing system 100 coming off any size of mattress in any position, regardless of the mattresses 1602 movement.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A bed clothing system that accommodates a mattress having a foot end and a head end, a bottom and a top, said mattress having a thickness that is one of a plurality of mattress thicknesses comprising:

a flat bottom sheet that includes an extended portion that wraps around said foot end of said mattress to form a first pocket by attaching said first extended portion of said flat bottom sheet that surrounds said foot end of said mattress to a first vertical edge and first horizontal edge of said flat bottom sheet, and a second pocket by attaching a second extended portion of said flat bottom sheet to a second vertical edge and a second horizontal edge of said flat bottom sheet that surrounds said head end of said mattress, said first pocket and said second pocket surrounding said mattress by an amount that securely holds said bottom sheet to said mattress, said first pocket comprising:

a first bottom sheet corner on said flat bottom sheet for placement on a first corner of said mattress at a foot end of said mattress, said first bottom sheet corner disposed on said mattress in a direction aligned with said thickness of said mattress;

a second bottom sheet corner on said flat bottom sheet for placement on a second corner of said mattress at a foot end of said mattress, said second bottom sheet corner disposed on said mattress in a direction aligned along said thickness of said mattress;

said second pocket comprising:

a third bottom sheet corner on said flat bottom sheet for placement on a third corner of said mattress at a head end of said mattress;

a fourth bottom sheet corner on said flat bottom sheet for placement on a fourth corner of said mattress at a head end of said mattress;

a flat top sheet that drapes over said bottom sheet and extends to at least a first bottom edge of said mattress, said flat top sheet comprising:

a first lengthwise vertical edge of said flat top sheet that extends along said first bottom sheet corner;

a second lengthwise vertical edge of said flat top sheet that extends along a second bottom sheet corner;

a portion of said top sheet that extends beyond said bottom of said mattress, said portion of said top sheet that extends beyond said bottom of said mattress attached to said first extended portion of said flat bottom sheet that surrounds said foot end of said mattress to form a clean hospital edge on said portion of said top sheet that extends beyond said bottom of said mattress;

a first separate strip of stretchable material, that does not form a portion of said flat top sheet, that extends along said first lengthwise vertical edge and not between said first lengthwise vertical edge and said second lengthwise vertical edge, said first strip of stretchable material attached to said first lengthwise vertical edge of said flat top sheet and said first bottom sheet corner to form a first stretchable corner that connects said flat top sheet and said flat bottom sheet and allows both said flat top sheet and said flat bottom sheet to expand in said direction of said mattress thickness to accommodate said plurality of mattress thicknesses and provide foot space at said foot end of said mattress adjacent to said first corner of said mattress;

a second separate strip of stretchable material that does not form a portion of said flat top sheet that extends along a length of said second lengthwise vertical edge and not between said first lengthwise vertical edge and said second lengthwise vertical edge, said second strip of stretchable material attached to said second lengthwise vertical edge of said flat top sheet and said second bottom sheet corner to form a second stretchable corner that connects said flat top sheet and said flat bottom sheet and allows both said flat top sheet and said flat bottom sheet to expand in said direction of said mattress thickness to accommodate said plurality of mattress thicknesses and provide foot space at said foot end of said mattress adjacent to said second corner of said mattress.

2. The bed clothing system of claim 1 wherein said first strip of stretchable material and said second strip of stretchable material are disposed between said flat top sheet and said flat bottom sheet.

3. The bed clothing system of claim 1 wherein said first strip of stretchable material and said second strip of stretchable material are disposed adjacent to said flat top sheet.

4. A bed clothing system that accommodates a mattress having a foot end, a head end, a top, a bottom and corners that extend between said top of said mattress and a bottom of said mattress, said mattress having a thickness that is one of a plurality of mattress thicknesses comprising:

a flat bottom sheet comprising:

a first bottom sheet edge, for placement adjacent to a first corner of said mattress at said foot end of said mattress, between said top and said bottom of said mattress;

a second bottom sheet edge, for placement adjacent to a second corner of said mattress, at said foot end of said mattress, that extends between said top and said bottom of said mattress;

a top sheet comprising:

a first top sheet edge, for placement adjacent to said first bottom sheet edge, that extends between said top and said bottom of said mattress along said first corner of said mattress;

a second top sheet edge, for placement adjacent to said second bottom sheet edge, that extends between said top and said bottom of said mattress along said second corner of said mattress;

an additional flat sheet section that forms a pocket that surrounds said foot end of said mattress comprising:

a first corner that is disposed adjacent to said first bottom sheet edge;

a second corner that is disposed adjacent to said second bottom sheet edge;

a first strip of stretchable material that is attached to said first corner of said additional flat sheet section, said first bottom sheet edge and said first top sheet edge that forms a first stretchable corner that allows said additional flat sheet section, said first bottom sheet edge and said first top sheet edge to expand at said foot end of said mattress to accommodate said plurality of mattress thicknesses and provide foot space at said foot end of said mattress;

a second strip of stretchable material that is attached to said second corner of said additional flat sheet section, said second bottom sheet edge and said second top sheet edge that forms a second stretchable corner that allows said additional flat sheet section, said second bottom sheet edge and said second top sheet edge to expand at said foot end of said mattress to accommodate said plurality of mattress thicknesses and provide foot space at said foot end of said mattress.

5. The bed clothing system of claim 4 wherein said first strip of stretchable material and said second strip of stretchable material are disposed between said additional flat section and said flat bottom sheet.

6. The bed clothing system of claim 4 wherein said first strip of stretchable material and said second strip of stretchable material are disposed on said additional flat sheet section.

7. A method of constructing a bed clothing system capable of accommodating a plurality of various mattress thicknesses comprising:

providing a flat bottom sheet comprising;

a first bottom sheet edge, for placement adjacent to a first corner of said mattress at said foot end of said mattress, between said top and said bottom of said mattress;

a second bottom sheet edge, for placement adjacent to a second corner of said mattress, at said foot end of said mattress, that extends between said top and said bottom of said mattress;

providing a flat top sheet comprising:

a first top sheet edge, for placement adjacent to said first bottom sheet edge, that extends between said top and said bottom of said mattress along said first corner of said mattress;

a second top sheet edge, for placement adjacent to said second bottom sheet edge, that extends between said top and said bottom of said mattress along said second corner of said mattress;

attaching a first strip of stretchable material to said first lateral edge of said flat top sheet and said first bottom sheet corner to form a first stretchable corner that connects said flat top sheet and said flat bottom sheet and allows both said flat top sheet and said flat bottom sheet to expand in said direction of said mattress thickness to accommodate said plurality of mattress thicknesses and provide foot space at said foot end of said mattress adjacent to said first corner of said mattress;

attaching a second strip of stretchable material to said second lateral edge of said flat top sheet and said second bottom sheet corner to form a second stretchable corner that connects said flat top sheet and said flat bottom sheet and allows both said flat top sheet and said flat bottom sheet to expand in said direction of said mattress thickness to accommodate said plurality of mattress thicknesses and provide foot space at said foot end of said mattress adjacent to said second corner of said mattress.

8. The method of claim 7 wherein said process of attaching said first strip and said second strip of stretchable material comprises attaching said first strip and said second strip of stretchable material between said flat top sheet and said flat bottom sheet.

9. The method of claim 7 wherein said process of attaching said first strip and said second strip of stretchable material comprises attaching said first strip and said second strip of stretchable material to said flat bottom sheet.

10. A method of constructing a bed clothing system capable of accommodating a plurality of various mattress thicknesses comprising:

providing a flat bottom sheet comprising;

a first bottom sheet edge, for placement adjacent to a first corner of said mattress at said foot end of said mattress, between said top and said bottom of said mattress;

a second bottom sheet edge, for placement adjacent to a second corner of said mattress, at said foot end of said mattress, that extends between said top and said bottom of said mattress;

providing a flat top sheet comprising:

a first top sheet edge, for placement adjacent to said first bottom sheet edge, that extends between said top and said bottom of said mattress along said first corner of said mattress;

a second top sheet edge, for placement adjacent to said second bottom sheet edge, that extends between said top and said bottom of said mattress along said second corner of said mattress;

providing an additional flat sheet section that forms a pocket that surrounds said foot end of said mattress comprising:

a first corner that is disposed adjacent to said first bottom sheet edge;

a second corner that is disposed adjacent to said second bottom sheet edge;

attaching a first trip of stretchable material to said first corner of said additional flat sheet section, said first bottom sheet edge and said first top sheet edge that forms a first stretchable corner that allows said additional flat sheet section, said first bottom sheet edge and said first top sheet edge to expand at said foot end of said mattress to accommodate said plurality of mattress thicknesses and provide foot space at said foot end of said mattress;

attaching a second strip of stretchable material to said second corner of said additional flat sheet section, said second bottom sheet edge and said second top sheet edge that forms a second stretchable corner that allows said additional flat sheet section, said second bottom sheet edge and said second top sheet edge to expand at said foot end of said mattress to accommodate said plurality of mattress thickness and provide foot space at said foot end of said mattress.

11. The method of claim 10 wherein said process of attaching said first strip and said second strip of stretchable material comprises attaching said first strip and said second strip between said additional flat sheet section and said flat bottom sheet.

12. The method of claim 10 wherein, said process of attaching said first strip and said second strip of stretchable material comprises attaching said first strip and said second strip of stretchable material to said additional flat sheet section.

* * * * *